US007635173B2

(12) United States Patent
Lyman et al.

(10) Patent No.: US 7,635,173 B2
(45) Date of Patent: Dec. 22, 2009

(54) INKJET PRINTER WITH SPILL DETECTION

(75) Inventors: Dan C. Lyman, Cincinnati, OH (US); Randy D. Vandagriff, Xenia, OH (US); John C. Loyd, Beavercreek, OH (US); Daniel J. DeVivo, Dayton, OH (US); Robert J. Simon, Bellbrook, OH (US)

(73) Assignee: Eastman Kodak Company, Rochester, NY (US)

( * ) Notice: Subject to any disclaimer, the term of this patent is extended or adjusted under 35 U.S.C. 154(b) by 305 days.

(21) Appl. No.: 11/263,143

(22) Filed: Oct. 31, 2005

(65) Prior Publication Data

US 2007/0097160 A1 May 3, 2007

(51) Int. Cl.
*B41J 2/175* (2006.01)

(52) U.S. Cl. ..... 347/7; 347/73; 347/14

(58) Field of Classification Search ..... 347/7, 347/85, 19, 2–3

See application file for complete search history.

(56) References Cited

U.S. PATENT DOCUMENTS

| | | | | |
|---|---|---|---|---|
| 6,796,627 | B2 * | 9/2004 | Kimura et al. | 347/7 |
| 6,935,729 | B2 * | 8/2005 | De Marco et al. | 347/73 |
| 2003/0095157 | A1 * | 5/2003 | Comer et al. | 347/3 |

* cited by examiner

*Primary Examiner*—Lam S Nguyen
(74) *Attorney, Agent, or Firm*—William R. Zimmerli

(57) ABSTRACT

An inkjet printer having an array of nozzles from which ink drops are emitted further includes a mechanism adapted to detect fluid levels in an ink supply tank to the inkjet printer while the printer is in idle mode, and shut down the printer when ink usage exceeds a predetermined volume.

11 Claims, 2 Drawing Sheets

INKJET PRINTER WITH SPILL DETECTION

CROSS REFERENCE TO RELATED APPLICATIONS

1. Field of the Invention

The embodiments relate to the field of digitally controlled printing devices, and in particular to inkjet printers.

2. Background of the Invention

Current inkjet printing systems consist of a fluid system supporting one or more printheads. Typical inkjet printheads operate by forcing fluid through a droplet generator, which can contain an array of orifices, and forming droplets of ink. The printhead is fully supported by the fluid system, controlling different solenoid valves and pumps to perform the necessary functions needed to operate the printhead reliably. The necessary functions include cleaning, startup, and shutdown. One particular function, shutdown, provides a means to stop the operation of the printhead and fluid system for an extended period of time. If either ink or flushing fluid is left in the drop generator during shut down, it can dry in and around the orifices, leaving behind non-volatile components in the form of solids or gels. Upon subsequent startups, the failure to remove or re-dissolve the solid or gel material in and around the orifices creates disturbances in the shape or direction of the emerging jets. This problem can be eliminated if instead of shutting down the printer between printing shifts or overnight, the printer is placed in an "idle" or "sleep mode" wherein fluid is continuously flowed through the printhead.

During normal operation continuous inkjet printers can use significant amounts of ink, due to their high print speeds. In addition to the ink used during printing, some of the ink vehicle, water or organic solvent may evaporate. Continuous inkjet printers typically incorporate some ink refill means to supply makeup fluid from one or more external makeup fluid tanks to refill the ink supply tank. In high speed, long array continuous inkjet printers the makeup fluid tanks can be as large as 200 liters.

As continuous inkjet printers require ink to be supplied under pressure to the printhead, there is the potential for a leak to develop through which ink can leak from the inkjet printer. Recognizing this risk, an ink retaining tray can be placed under the fluid system of the inkjet printer to hold any fluid that may have leaked from the fluid system. A detector is normally located in the ink retaining tray to detect the presence of any fluid that may have leaked from the fluid system. Upon the detection of a leak, the printer is automatically shutdown.

During operation, leaks can occur in the printhead or in the umbilical lines, which connect the printhead to the fluid systems. This leaking fluid will not be in the retaining ink tray and thus not detected by the described means. Rather, ink leaks during print operation from the printhead or umbilical can be easily seen by the operator, who can shut the printer down before large amount of ink has leaked out.

When the printer is in the idle or sleep mode of operation, such as overnight or between print shifts, the printer is typically left unattended. If a leak were to occur in the printhead or umbilical while in the sleep mode, an operator is typically not present to detect the leak. As liquid continues to leak from the printer, the ink refill means tries to compensate the fluid level in the ink supply tank by transferring fluid from the makeup fluid tank. In a worst case scenario, ink could continue to leak from the printer until the ink supply tank and the makeup fluid tank are emptied. As the makeup fluid tank can be as large as 200 liters, a significant mess could occur.

A need exists for a quick shut down or a termination of ink flow should a leak occur during the sleep mode of inkjet printers.

While the prior art systems for spill detection using liquid sensors located in spill containment tray are effective in detecting leaks from many of the fluid handling components of the printer, the prior art system cannot detect leaks from portions of the printer that are not located over the spill containment tray.

A need exists for a manner to detect leakage from printer components hat are not located over the spill containment sensor.

A need exists for a printer that can operate in an unattended standby mode and can automatically shut down quickly when a leak is detected. A need exists to prevent routine clogging of the inkjet printheads of the printer by nightly shut down while eliminating the risk of significant amounts of liquid leaking from the inkjet printer.

The embodiments meet these needs.

SUMMARY OF THE INVENTION

The embodiments are directed towards an inkjet printer for minimizing fluid spills during operation in an idle, standby, or sleep-mode, i.e. a non-printing mode. The inkjet printer has a printhead, an ink supply tank, a makeup fluid tank for holding fluid to be transferred to the ink supply tank, and a usage rate sensor. The usage rate sensor is used to determine the usage rate of fluid transferred from the makeup fluid tank to the ink supply tank. A controller compares the usage rate to a predetermined usage rate. Depending upon the usage rate in comparison to the predetermined usage rate, the controller initiates steps to limit or minimize the amount of fluid spilled. Examples of steps that controller can initiate include disabling transfer of makeup fluid from the makeup fluid tank to the ink supply reservoir; shutting down the one or more printheads; shutting down the inkjet printer; producing an alarm; transmitting an alarm signal to a remote site of operator; or combinations thereof.

The embodiments are directed towards a method of inkjet printing using a printhead having a linear array of nozzles from which fluid droplets are emitted by monitoring fluid usage from an ink supply tank, comparing monitored fluid usage against a predetermined rate, and controlling fluid usage by selectively preventing fluid from entering the ink supply tank or shutting down the inkjet printer.

BRIEF DESCRIPTION OF THE DRAWINGS

In the detailed description of the preferred embodiments of the invention presented below, reference is made to the accompanying drawings, in which.

Other features and advantages of the present invention will become apparent from the following description of preferred embodiments of the invention.

DETAILED DESCRIPTION OF THE INVENTION

The present description will be directed in particular to elements forming a part of, or cooperating more directly with, an apparatus in accordance with the present invention. It is to be understood that elements not specifically shown or described may take various forms well known to those skilled in the art.

The embodiments contemplate a mechanism to prevent or minimize fluid spills in continuous inkjet printers operating a standby, idle or sleep, non-printing mode by shutting down the inkjet printer, if a fluid leak is detected. The embodiments contemplate a mechanism to prevent fluid spills of ink or replenishing fluid from a make up fluid tank and from refilling an ink supply tank.

Since the separate plumbing within each printhead interface controller (PIC) and printhead is identical, parts of the following description will make reference only to a single printhead, without restricting the invention to a single printhead.

Figure 1:
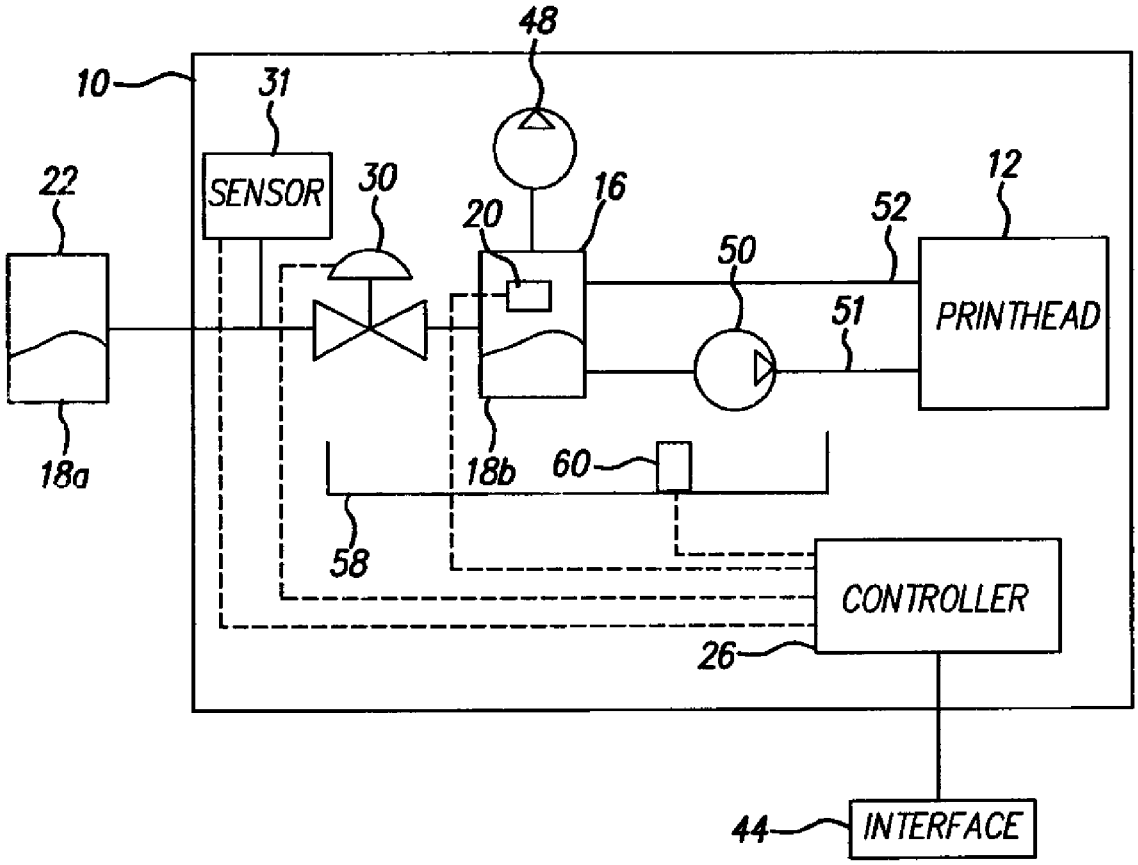
FIG. 1 depicts an inkjet printer with an embodiment mechanism.

With reference to the figures, FIG. 1 illustrates an exemplary inkjet printer 10. The printhead(s) may be of any suitable type, such as for example, 300×1200 dots per inch (dpi) printheads.

In FIG. 1, fluid 18*b* is pumped to at least one printhead 12 by pump 50 through fluid line 51 contained in an umbilical. Fluid that is not directed at print media for printing is returned to the ink supply tank 16 via fluid return line 52. The air above the ink in the ink supply tank 16 can be maintained at a partial vacuum of 10 to 18 inHg by vacuum pump 48, providing a pressure gradient for flow of ink back to the ink supply tank 16. The fluid level in the ink supply tank 16 can be monitored by fluid level sensor 20 associated with the ink supply tank 16 that transmits fluid level information to a controller 26. The fluid level sensor 20 can be part of the usage rate sensor. The fluid level sensor 20 can be in connection with the controller via a serial port, an Ethernet connection, a wireless network connection, or combinations thereof.

When the fluid level in the ink supply tank drops below a set point, the controller 26 causes intake valve 30 to allow makeup fluid 18*a* to be transferred from a makeup fluid tank 22 into the ink supply tank 16. When the proper fluid level in the ink supply tank 16 is reached, the controller 26 causes the intake valve 30 to stop transfer of makeup fluid into the ink supply tank 16.

A spill containment tray 58 is located under the fluid system so that fluid leaking from the fluid system might be contained. A liquid sensor 60 in the spill containment tray 58 can communicate the presence of liquid in the spill containment tray to the controller 26, which can initiate a shutdown of the printer.

According to the embodiments, leakage of fluid from the printer can be detected by monitoring the rate at which makeup fluid must be supplied to the ink supply tank 16 to maintain the proper fluid level in the ink supply tank. When the printer is being operated in the "idle" or "sleep" mode, no ink is printed. In the absence of any leaks, makeup fluid 18*a* needs to be transferred from the makeup fluid tank 22 to the ink supply tank 16 only to make up for fluid that has evaporated. A usage rate above a predetermined usage rate, which accounts for evaporation, is therefore indicative of fluid leaking from the printer.

The predetermined usage rates can be based on the number and type of printhead installed on the printer, atmospheric conditions such as temperature, humidity, and atmospheric pressure. These parameters are all known to affect fluid evaporation rates. The predetermined usage rates can be predefined and stored in memory associated with the controller 26 at production or can be entered by an operator through a user interface 44.

The usage rate of fluid can be determined by using a flow sensor 31 in the supply line between the makeup fluid tank 22 and ink supply tank 16, or by the amount or quantity of time needed to fill the ink supply tank, the amount of time between refills of the ink supply tank, or combinations of these elements.

In one embodiment used in a printer with a nine inch array of approximately 2700 nozzles, testing for excessive usage rates involves both testing the time required to refill the ink supply tank and the time between refills of the ink supply tank. The test for excessive time to refill the ink tank is of particular value in detecting high flow rate leaks. For this refill time test, the predetermined usage rate is expressed in time to complete a refill. In this example embodiment, a predetermined usage rate of three minutes for the refill is employed. For slow leaks, the time to refill the ink supply tank is not an effective test method. In situations with slow leaks, the time between refills provides a more sensitive test. For this test, the predetermined usage rate can be expressed in the form of time between refills or by the number of refills in a given time interval. For this embodiment, the predetermined usage rate is set as four refills in an hour or six refills in two hours. The fluid usage rate can be controlled and monitored by a flow sensor in the supply line between the makeup fluid tank and the ink supply tank.

When the controller determines that the usage rate exceeds the predetermined usage rate, the controller 26 initiates steps to minimize the leakage. The steps to minimize leakage can include disabling further transfer of makeup fluid from the makeup fluid tank to the ink supply reservoir, shutting down at least one printhead, turning off the printer, producing an alarm, or transmitting an alarm signal to a remote site of operator.

The fluid level sensor 20 can be one or more types of fluid level sensors. For example, fluid level sensors can be a floating fluid level sensor that transmits wirelessly to the controller. The fluid level sensor can be a hardwired, fixed fluid level sensor mounted to the interior of the ink supply tank. The fluid level sensor can be a floating fluid level sensor, an electrical continuity sensor for detecting fluid levels, a capacitance based fluid level sensor, an ultrasonic fluid level sensor, a weight sensor, a mass sensor, an optical sensor, or other similar sensor. The sensor output can be transferred to a controller 26 by any suitable means such as hardwired connection, serial port, wireless transmission, Ethernet connection, optical fiber transmission, or combinations thereof. In one embodiment, the fluid level sensor is a floating fluid level sensor known as a GEMS L300 model. When the GEMS L300 level sensor is used, the hysteresis in the sensor between indicating low fluid level and the properly refilled fluid level results in a fairly consistent amount, about 50 mL, of fluid being transferred from the makeup fluid tank and the ink supply tank.

A mechanism is contemplated with a controller 26 in communication with a fluid level sensor 20 to prevent spills of the fluid during printer operation in a standby mode. The mechanism can include computer instructions within the controller in communication with data storage 223, a processor 210 and a memory 220. The controller 26 can be a PC computer, a laptop, or similar computational device. The controller 26 can be monitored remotely and administered through a remote server or through a website with a user interface 44 in communication with the controller 26. The controller 26 is able to selectively shut down either one of the printheads 12, or both the printheads, or alternatively close the intake valve 30 to prevent fluid spills.

The user interface 44 is used to input preset or predetermined usage rates via the website to the controller 26.

The controller 26 receives signals from the fluid level sensor 20, which provides information on actual usage rates of fluid by the inkjet printer 10.

A controller 26 can be external to the ink supply tank in communication with the fluid level sensor 20. For example, the controller 26 monitors ink usage from the ink supply tank 16 and compares ink usage by the inkjet printer 10 against preset usage rates input to the controller 26 for at least one printhead 12. Shut down of at least one inkjet printhead 12 is initiated by the controller 26 when the ink usage exceeds the preset usage rate, thereby minimizing ink spills.

The embodiments use the user interface to input the predetermined values for printhead ink use during standby mode or some other mode.

The processor compares the signals from the fluid level sensor 20 and either shuts down the printheads or closes the intake valve 30 when fluid usage as exceeds a predetermined fluid usage rate. Computer instructions enable the controller 26 to selectively switch between closing the intake valve 30 and shutting down one or more printheads 12 to prevent fluid spills.

The fluid 18*a* in the make up fluid tank 22 is ink, a replenishing fluid, or a cleaning fluid. The fluid in the ink supply tank 16 is ink, replenishing fluid, or a cleaning fluid. Examples of fluid include dye-based inks, pigment-based inks, aqueous inks, solvent inks, synthetic inks, polymer inks, and the like.

The embodied methods entail monitoring fluid usage from an ink supply tank 16 and comparing the monitored fluid usage against a predetermined rate. Controlling fluid usage is done by selectively preventing fluid from entering the ink supply tank 16 or shutting down the inkjet printer 12. The embodied methods are not limited to linear arrays and can apply to other arrays or even to single jet printers.

The embodiments include computer readable medium having stored thereon a plurality of instructions, the plurality of instructions including instructions which, when executed by a processor 210, cause the processor to perform the embodied methods for minimizing fluid spills during operation as described above.

Figure 2:
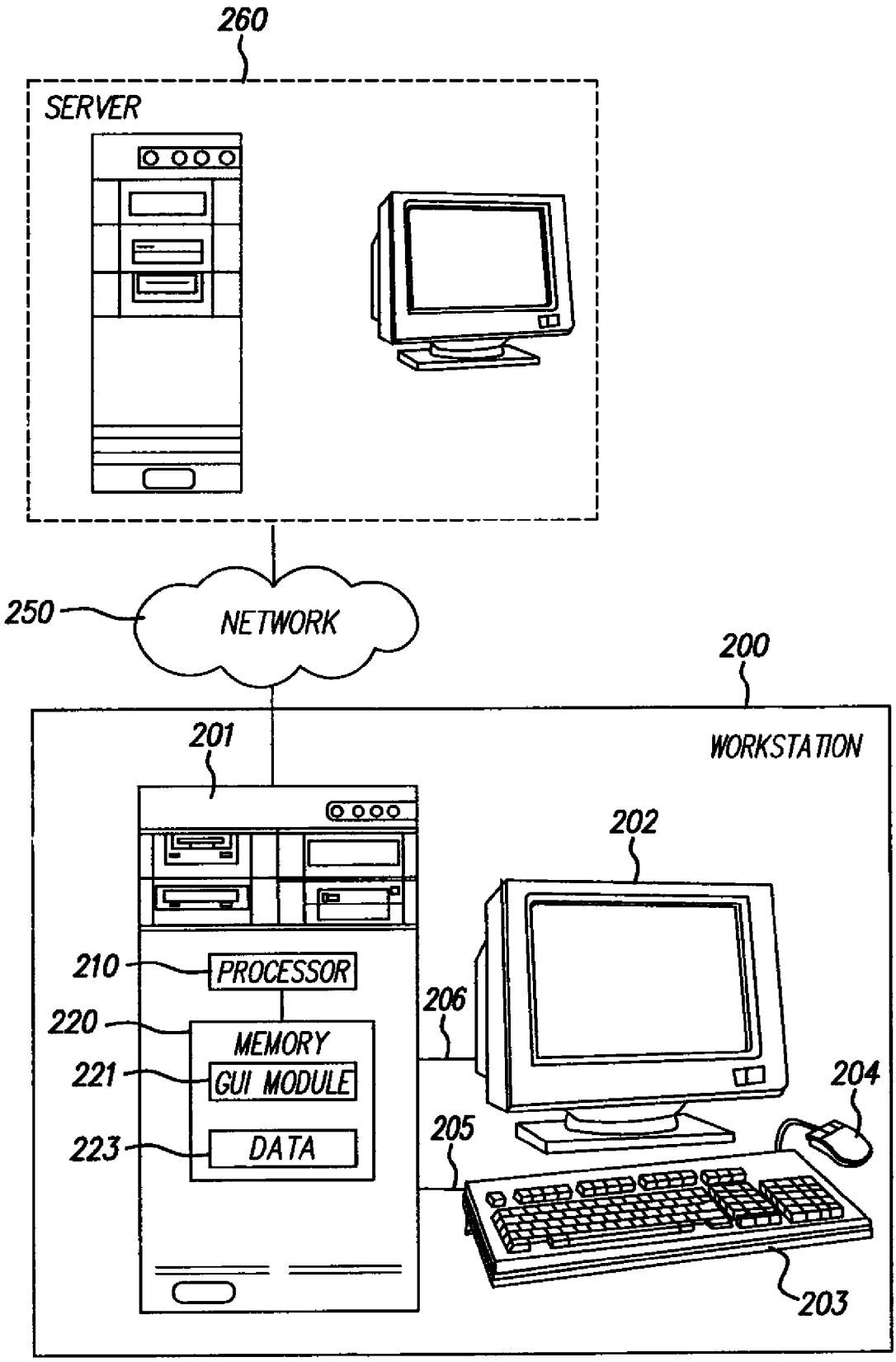
FIG. 2 depicts an illustration of a computer system to perform the embodied methods.

FIG. 2 depicts an illustration of a computer system to perform the embodied methods. The controller 26 can utilize a computer system similar the system depicted in FIG. 2 to perform the embodied methods for minimizing fluid spills. A workstation 200 includes computer 201, which can be coupled to a video display 202 via an external graphics bus 206. The external graphics bus 206 can be an Advanced Graphics Port (AGP) compliant bus. The term "coupled" encompasses a direct connection, an indirect connection, or the like. Computer 201 in one embodiment includes a processor 210, such as the Pentium™ III processor manufactured by Intel Corp. of Santa Clara, Calif. In another embodiment, the processor 210 can be an Application Specific Integrated Circuit (ASIC). Computer 201 can include a memory 220 coupled to the processor 210. Memory 220 encompasses devices adapted to store digital information, such as Dynamic Random Access Memory (DRAM), Rambus™ DRAM (RDRAM), flash memory, a hard disk, an optical digital storage device, a combination thereof, etc. The computer 201 can be coupled to a keyboard 203 and a mouse 204 via an external computer bus 205. In one embodiment, the external computer bus 205 is a Universal Serial Bus (USB) compliant bus.

Memory 220 can include instructions adapted to be executed by the processor 210 to perform a method in accordance with an embodiment of the present invention. The term "instructions adapted to be executed" is meant to encompass any instructions that are ready to be executed in their present form (for example, machine code) by a processor, or require further manipulation (for example, compilation, decryption, decoding, or provided with an access code, etc.) to be ready to be executed by a processor (for example, processor 210). In one embodiment, the memory 220 can include a graphical user interface (GUI) module 221 to implement a graphical user interface.

In another embodiment, the workstation 200 is coupled to a server 260 via a network 250. Examples of network 250 include the internet, a WAN (wide area network), LAN (local area network), an intranet, a communications network, a computer network, a combination thereof, etc. In one embodiment, the server 260 is coupled to a storage device that typically stores data on a magnetic medium such as a magnetic disk. For example, the storage device may store application programs and associated data files/documents. Examples of documents include word processing documents, spreadsheet documents, HTML (Hypertext Markup Language) documents, and the like. Workstation 200 can access data 223 stored in the storage device via server 260 and network 250. In an embodiment, server 260 can display information on display 202 by sending information signals to workstation 200 via network 250. Examples of display information include data a GUI component, a web page, and the like.

Data 223 can encompass hierarchical data, non-hierarchical data, and the like. Data 223 can be a document corresponding to a particular application such as a word processing document, a spreadsheet document, an HTML document, and the like.

Computer instructions adapted to be executed by a processor 210 to perform the embodied methods are stored on a computer-readable medium and distributed as software. The computer-readable medium can be a device that stores digital information. For example, a computer-readable medium includes a portable magnetic disk, such as a floppy disk; or a Zip™ disk, manufactured by the Iomega Corporation of Roy, Utah (Zip™ is a registered trademark of Iomega Corporation); or a Compact Disk Read Only Memory (CD-ROM) as is known in the art for distributing software. The computer-readable medium can be distributed to a user that has a processor suitable for executing instructions adapted to be executed.

The embodiments have been described in detail with particular reference to certain preferred embodiments thereof, but it will be understood that variations and modifications can be effected within the spirit and scope of the invention.

PARTS LIST

10 inkjet printer
12 printhead
16 ink supply tank
18*a* fluid
18*b* fluid
20 fluid level sensor
22 makeup fluid tank
26 controller
30 intake valve
31 flow sensor
44 user interface
48 vacuum pump
50 ink pump
51 fluid line
52 fluid return line
58 spill containment tray
60 liquid sensor

200 workstation
201 computer
202 display
203 keyboard
204 mouse
205 external computer bus
206 external graphics bus
210 processor
220 memory
221 graphical user interface module
223 data
250 network
260 server The invention claimed:

1. A method of operating a continuous inkjet printer, including a printhead having a linear array of nozzles from which fluid droplets are emitted, in a non-printing maintenance mode which is used instead of shutting down the inkjet printer during an extended time interval when the inkjet printer is not being used for printing, comprising:

a. monitoring a usage rate of fluid transferred from a makeup fluid tank to an ink supply tank while the continuous inkjet printer is operating in the non-printing maintenance mode, wherein the non-printing maintenance mode is a sleep mode in which fluid is continuously flowed through the printhead to prevent the fluid from drying in the printhead during the sleep mode;

b. comparing the fluid usage rate monitored against a predetermined usage rate that accounts for fluid evaporization during the sleep mode; and c. limiting fluid spillage by selectively preventing fluid from entering the ink supply tank or by shutting down the inkjet printer if the fluid usage rate exceeds the predetermined usage rate during the sleep mode.

2. The method of claim 1, wherein the fluid usage rate is based on a member of the group consisting of an amount of time needed to fill the ink supply tank, an amount of time needed between refills of the ink supply tank, and combinations thereof.

3. The method of claim 1, wherein the step of limiting fluid spillage from entering the ink supply tank is performed by closing a valve from the makeup fluid tank to the ink supply tank.

4. The method of claim 1, wherein the step of comparing the fluid usage rate monitored against a predetermined usage rate is performed remotely from the inkjet printer.

5. The method of claim 4, wherein the step of comparing the fluid usage rate monitored against the predetermined usage rate is performed remotely by a processor or a server system accessible through the internet.

6. A computer readable medium having stored thereon a plurality of instructions, the plurality of instructions including instructions which, when executed by a processor, cause the processor to perform the steps of:

a. monitoring a usage rate of fluid transferred from a makeup fluid tank to an ink supply tank in a continuous inkjet printer while the continuous inkjet printer is operating in a non-printing maintenance mode which is used instead of shutting down the inkjet printer during an extended time interval when the inkjet printer is not being used for printing, wherein the non-printing maintenance mode is a sleep mode in which fluid is continuously flowed through a printhead to prevent the fluid from drying in the printhead during the sleep mode;

b. comparing the fluid usage rate monitored against a predetermined usage rate that accounts for fluid evaporization during the sleep mode; and c. limiting fluid spillage by selectively preventing fluid from entering the ink supply tank or by shutting down the inkjet printer if the fluid usage rate exceeds the predetermined usage rate during the sleep mode.

7. The computer readable medium of claim 6, wherein the step of limiting fluid spillage is performed by a step selected from the group consisting of:

a. disabling transfer of makeup fluid from the makeup fluid tank to the ink supply tank;

b. shutting down the printhead;

c. shutting down the inkjet printer;

d. producing an audio alarm;

e. transmitting an alarm signal to a remote site of operation; and f. combinations thereof.

8. The computer readable medium of claim 6, wherein the fluid usage rate is based on a member of the group consisting of an amount of time needed to fill the ink supply tank, an amount of time needed between refills of the ink supply tank, a flow sensor in a supply line between the makeup fluid tank and the ink supply tank, and combinations thereof of.

9. The computer readable medium of claim 6, wherein the step of controlling fluid usage from entering the ink supply tank is performed by closing a valve from the makeup fluid tank to the ink supply tank.

10. The computer readable medium of claim 9, wherein the step of comparing the fluid usage rate monitored against the predetermined usage rate is performed remotely by a processor or a server system accessible through the internet.

11. The computer readable medium of claim 6, wherein the step of comparing the fluid usage rate monitored against the predetermined usage rate is performed remotely from the inkjet printer.

* * * * *